US005697537A

United States Patent [19]

Bowlsby

[11] Patent Number: 5,697,537

[45] Date of Patent: Dec. 16, 1997

[54] BELT-MOUNTED HUNTER'S BOW REST

[76] Inventor: David Bowlsby, 829 Taughannock Blvd., Ithaca, N.Y. 14850

[21] Appl. No.: 625,526

[22] Filed: Mar. 28, 1996

[51] Int. Cl.[6] ..... A45F 5/00

[52] U.S. Cl. ..... 224/270; 224/916; 224/678; 224/268; D3/215; D3/221

[58] Field of Search ..... 224/916, 660, 224/673, 676, 678, 677, 679, 247, 248, 268, 270; D3/215, 221, 228, 262

[56] References Cited

U.S. PATENT DOCUMENTS

| | | | |
|---|---|---|---|
| 2,651,441 | 9/1953 | Rau et al. | 224/268 |
| 2,926,403 | 3/1960 | Weissman | 224/247 |
| 3,434,638 | 3/1969 | Beynon | 224/916 |
| 3,696,978 | 10/1972 | Gentellalli | 224/916 |
| 3,963,156 | 6/1976 | Perrin . | |
| 4,121,743 | 10/1978 | Burton . | |
| 4,607,606 | 8/1986 | Schaar | 224/916 |
| 4,684,047 | 8/1987 | Burgwin | 224/916 |
| 4,830,244 | 5/1989 | Brannon | 224/677 |
| 4,883,290 | 11/1989 | Landa | 224/677 |
| 4,896,806 | 1/1990 | Sanchez, Jr. | 224/270 |
| 4,977,860 | 12/1990 | Harwell | 224/678 |
| 5,050,786 | 9/1991 | DeMott | 224/677 |
| 5,232,136 | 8/1993 | Unger | 224/247 |
| 5,239,976 | 8/1993 | Specht | 224/916 |
| 5,388,741 | 2/1995 | Hillinger | 224/679 |
| 5,423,530 | 6/1995 | Gonzalez | 224/678 |
| 5,477,997 | 12/1995 | Weatherly | 224/677 |
| 5,494,202 | 2/1996 | Wyatt | 224/679 |
| 5,511,707 | 4/1996 | Reichert | 224/270 |

*Primary Examiner*—Henry J. Recla
*Assistant Examiner*—Gregory M. Vidovich
*Attorney, Agent, or Firm*—Brown, Pinnisi & Michaels

[57] ABSTRACT

A bow holder which can attach to any hunter's waist either through belt loops or by tucking behind the belt or inside the waistband of the hunter's pants. The bow holder is built on a stabilizing plate which extends downward to support the holder against the hunter's leg. The bow rests on top of a generally horizontal base area, held from slipping sideways by a lip. The base is provided with a notch to receive the bow's stabilizer bar or a simple bolt screwed into the stabilizer bar fitting. The notch is preferably inclined to the vertical, such that the bow string is inclined inwardly toward the hunter's upper body, and the stabilizer bar or nocked arrow point is angled outwardly from the hunter's leg. The provision of a second angled notch on the opposite side of the base from the first notch allows the bow to be carried with its center of gravity either in front of or behind the holder, which changes the angle of the bow axis from a tilted-forward "ready" position to a tilted-back "transport" position.

11 Claims, 4 Drawing Sheets

BELT-MOUNTED HUNTER'S BOW REST

FIELD OF THE INVENTION

The invention pertains to the field of hunting accessories. More particularly, the invention pertains to carrying devices for securing bows to a hunter's body for easy transport and use.

BACKGROUND OF THE INVENTION

The sport of bowhunting has gained a great deal of popularity in recent years. Many states have special hunting seasons for bowhunting. The hunter who chooses to use a bow and arrows must carry the weapon and ammunition, and the other apparatus into the woods. Unlike gun hunters, bowhunters often hunt from tree stands, which puts a premium on balance and keeping hands free. Therefore, there is a need for a method of keeping the hunter's bow out of his way as he proceeds through the woods or climbs to the stand, yet have it available when the prey appears.

There have been a number of rests or holsters patented. Typical of these are the following:

Perrin, U.S. Pat. No. 3,963,156, is a belt with a pair of U-shaped hook members secured by clips to a plate. The cradle thus formed is intended as a gun rest, rather than bows. The belt is part of the invention, eliminating the ability to use the invention with any belt. The U-shaped clips would not affect the angle of rest of a bow.

Burton, U.S. Pat. No. 4,121,743, is a transport holder for bows, which uses a special "T"-shaped rail on the bow, mating with a slotted holder on a holster, similar to the method used to hang microphones on mobile radios. The holster can be used with any belt, but the invention requires the addition of the special T-rail to the bow, which also fixes the point of attachment of the bow to the holder. If the hunter has more than one bow, it becomes necessary to have more than one T-rail. Also, the various designs which use special attachment devices tend to make it tricky to hang the bow without looking at the bow while attempting to mate the bow and the holder. This can be counterproductive when trying to watch out for game, or while in a tree-stand.

SUMMARY OF THE INVENTION

The invention presents a bow holder which can attach to any hunter's waist either through belt loops or by tucking behind the belt or inside the waistband of the hunter's pants. The bow holder is built on a stabilizing plate which extends downward to support the holder against the hunter's leg. The bow rests on top of a generally horizontal base area, held from slipping sideways by a lip. The base is provided with a notch to receive the bow's stabilizer bar or a simple bolt screwed into the stabilizer bar fitting. The notch can be inclined to the vertical, such that the bow string is inclined inwardly toward the hunter's upper body, and the stabilizer bar or necked arrow point is angled outwardly from the hunter's leg. The provision of a second angled notch on the opposite side of the base from the first notch allows the bow to be held with its center of gravity either in front of or behind the holder, which changes the angle of the bow axis from a tilted-forward "ready" position to a tilted-back "transport" position.

DESCRIPTION OF THE PREFERRED EMBODIMENT

Figure 1:
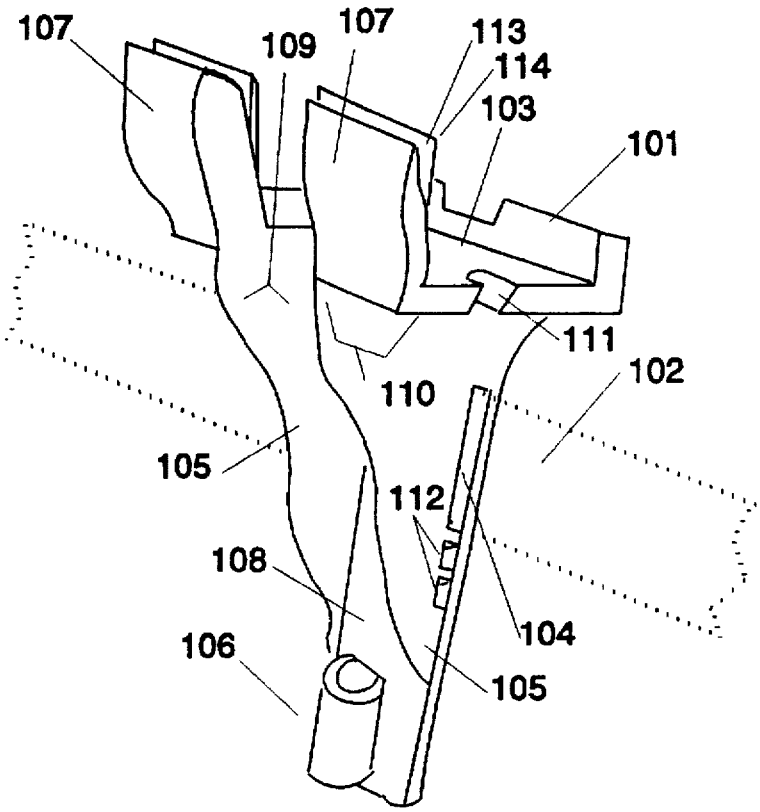
FIG. 1 shows a view of the preferred embodiment of the invention.

FIG. 1 shows the preferred embodiment of the invention, in which all of the parts are easily molded in a single operation in plastic or the like.

A stabilizing plate (108) serves to support the parts of the invention against the body of the user. It extends downward from the hunter's belt (102) a sufficient distance to stabilize the bow when it is seated in the holder. Belt slots (104) are provided through which the belt (102) may be threaded, so as to hold the bow holder stably to the body of the hunter. Multiple knock-outs (112) are preferably provided, so that the invention can be adapted for use with various size belts.

The body (105) of the holder, in the form of two flanges, projects outward from the plate (108) a sufficient distance to support a bow on its generally flat top surface (103). If desired, the top surface (103) could be slightly concave. An inner lip (101) and outer lips (107) project above the top surface (103) of the body (105), so as to keep the bow from sliding outward off the rest. The inner side of the outer lip (107) optionally has a string notch (113) between the outer lip (107) and a secondary lip (114), which allows the bow to be hung from the holster by its bowstring, as shown in FIG. 4*c*.

Figure 8:
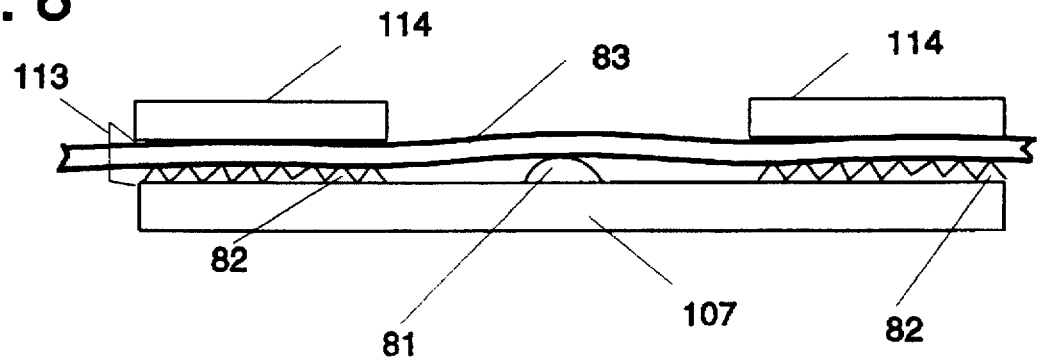
FIG. 8 shows a top view of the invention, showing an adaptation to hold the bowstring in the string notch.

FIG. 8 shows in a top view how the string notch (113), between the outer lip (107) and the secondary lip (114) may be made more effective. This is especially important if the holder of the invention is made of a slippery material such as a plastic, such that the bowstring might tend to slip fore-and-aft through the string notch. The string (83) is held in place by teeth (82) inside the bow notch (113). A central flange (81) presses the bowstring (83) inward, increasing the grip of the secondary lips (114) and the teeth (82) against the bowstring. Alternatively, the string notch (113) could be coated with a resilient non-slip substance such as rubber or soft plastic.

Figure 6:
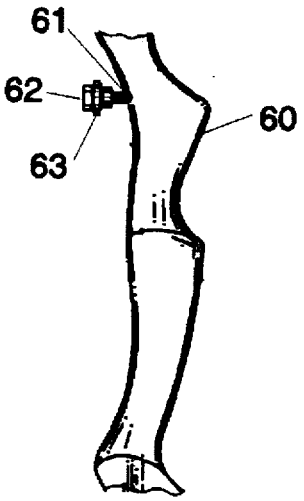
FIG. 6 shows a section of a bow, with the stabilizing bar replaced by a bolt and bushing for use with the invention.

Many bows have provision for a stabilizer bar, which normally extends forward from the bow center grip to counterbalance the weight of the bow behind the archer's hand. As shown in FIG. 6, a simple machine bolt (61) will fit in the threaded accessory hole in the bow handle (60). The hex head (62) of the bolt holds a bushing (63), which will act as a stop when the bolt (61) is fit in the slots in the holder, as will be discussed below. Other types of bolts, such as carriage bolts or custom-made plastic bolts incorporating the bushing into their structure could be used, with the thread and size of the bolt matching the accessory hole in the bow—5/16"–24 is currently the standard size and thread used by bow manufacturers.

Figure 7:
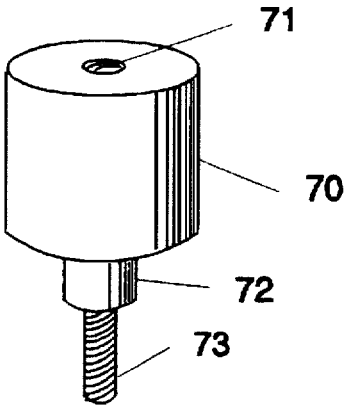
FIG. 7 shows a detail of a stand-off which can be used to adapt a bow with a stabilizer bar to use with the invention.

If desired, the stabilizer bar could be left on the bow, with the bushing slipping over the stabilizer bar threads. For longer-term use, a special standoff, as shown in FIG. 7, could be used to adapt the bow to the holder of the invention. Referring to FIG. 7, the standoff has a body (70) which has a threaded hole (71), preferably of the standard 5/16"–24 thread and at least ½" deep, into which the stablizer bar can be screwed. The body (70) has a reduced stem (72) underneath, which is of a diameter which will fit in the slot in the holder of the invention. The reduced stem, in turn, has a threaded bolt (73), again preferably of the standard 5/16"–24 thread, protruding from the bottom which threads into the accessory hole in the bow. The body is preferably approximately ¾" tall above the reduced stem, which is preferably ¼" in height. The threaded bolt is preferably ½" in length, for a total of 1½" total length of the body, stem and bolt.

In both outer ends of the top surface (103), a slot (111) is formed. The slots (111) are spaced outwards of the flanges (105) a sufficient distance (110) such that a standard 1½" diameter stabilizer bar will clear the flanges (105) of the body. The bushing (63) as shown in FIG. 6 on a bolt, or mounted under the stabilizer bar, will lock the bow downward against the top surface (103) of the body. Two slots (111) are shown, one on each side. This allows for right- or left-handed archers, and allows for the positioning of the bow as discussed below.

A gap (109) between the flanges (105) provides room for the stabilizer bar on the bow, if the bushing or standoff is not used to lock the bow into the slots (111).

A fitting (106) at the lower end of the stabilizing plate (108) can be provided into which a spike can be inserted or threaded, so that the bow holder of the invention can also serve as a ground support to hold the bow when the hunter is stationary. The fitting (106) can also interlock with matching rod on a tree stand, to support the bow on the stand.

Figure 2:
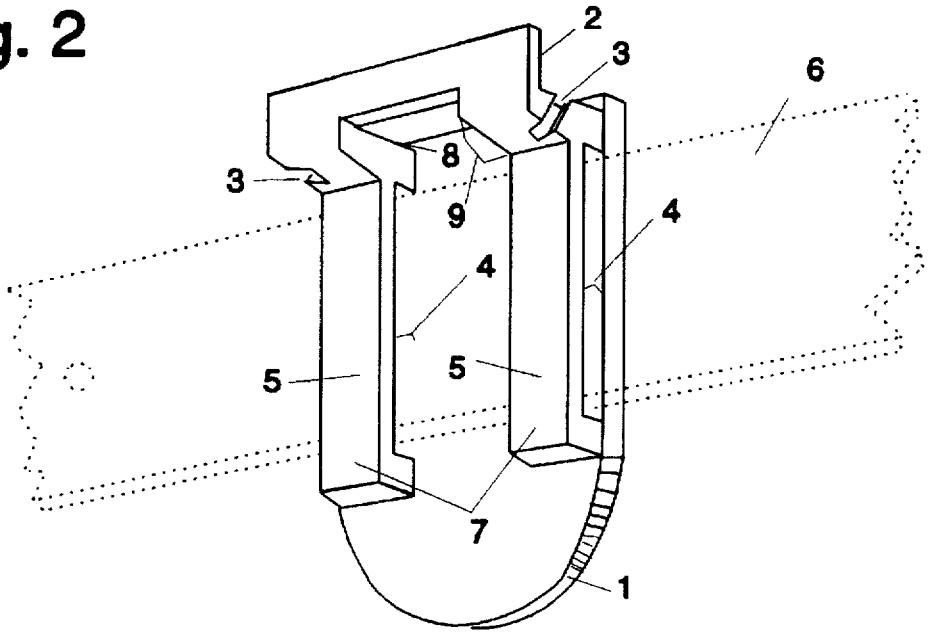
FIG. 2 shows a view of a second embodiment of the invention.

FIG. 2 shows another embodiment of the invention, in which the body (7) is divided into two parts (5) on the stabilizing base (1), joined by a single outer lip (2). This permits the stabilizer bar on the bow, if any, to fit between the two halves of the body (5) behind the outer lip (2), and eliminates extra material which might add weight and expense.

In any case, the same elements are present as discussed in FIG. 1, above. The hunter's belt (6) passes through belt gaps (4) in the body halves (5), holding the stabilizing plate (1) against the hunter's body. Lips (2) are provided on the top of the body halves (5) to hold the bow on the top surface (8). Slots (3) are provided in one or both body halves (5), slanted relative to the vertical as discussed below. No specific recesses are required, as the bushing in the slot can press against the bottom of the body to hold the bow down. The spacing of the slot (3) on the lower side (9) of the body, outward from the body halves (5), is preferably sufficient to clear the bushing or the standoff on a stabilizer bar.

Figure 3:
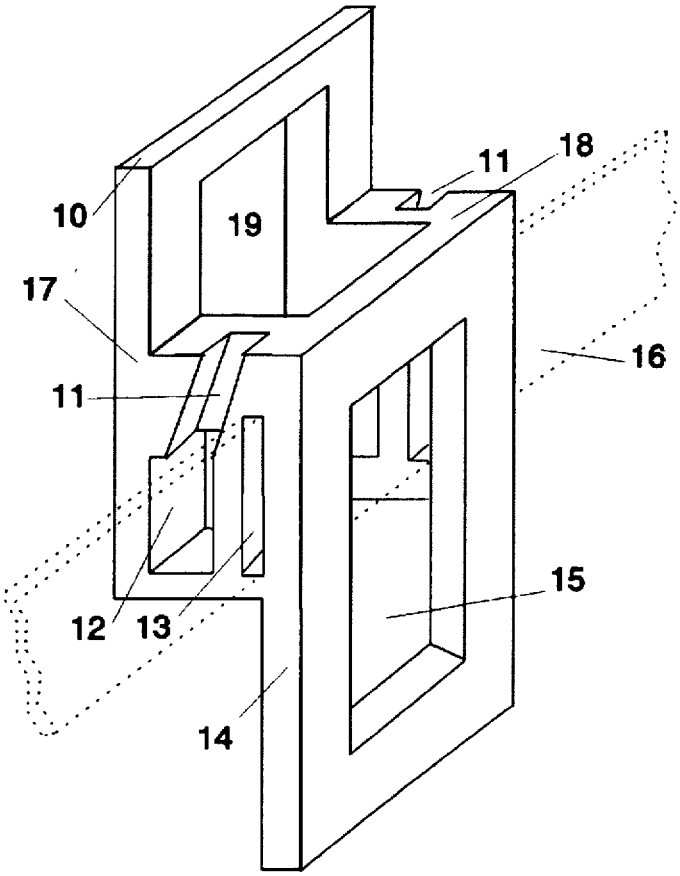
FIG. 3 shows a view of a third embodiment of the invention.

FIG. 3 shows a simple form of the invention, in which all parts are formed into one unitary assembly, and all planes are flat for easy and inexpensive manufacture.

The stabilizer plate (14), body (17) and lip (10) form a "z" shaped construct. The belt slot (13) is molded in.

The slots (11) are at an angle to the vertical, as shown, to accommodate the bolt and bushing attached to the bow, and to hold the bow at an angle to the vertical which will aim the bowstring toward the hunter's body and a nocked arrow point away from his leg. Recess (12) provides room for the bolt head and bushing. Additional recesses (15) and (19) are provided to make the invention lighter. In addition, the outer recess (19) can provide room for a stabilizer bar on the bow, if it is so equipped.

Figure 5:
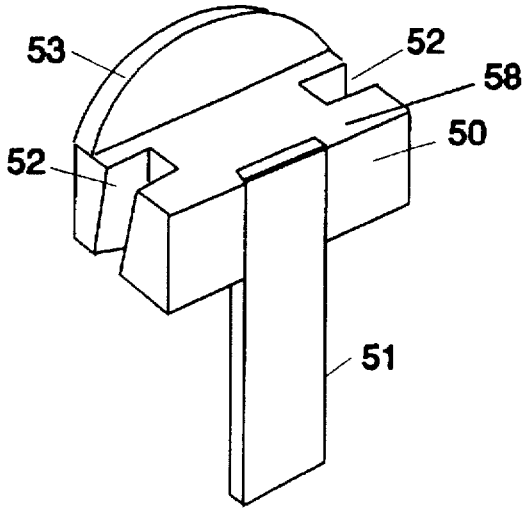
FIG. 5 shows a fourth embodiment of the invention, in which the stabilizing plate is designed to slip behind a belt.

FIG. 5 shows yet another embodiment of the invention, in a simpler form. The body (50) is fitted with slots (52), again slanted, holding the bow at an angle against the top surface (58) of the body (50). A lip (53) keeps the bow from sliding off. Instead of belt loops or gaps, the stabilizing plate (51) is held in place by being formed as an elongated tongue which can be tucked under the hunter's belt, either inside the waistband of his pants or outside between the belt and pants.

Figure 4A:
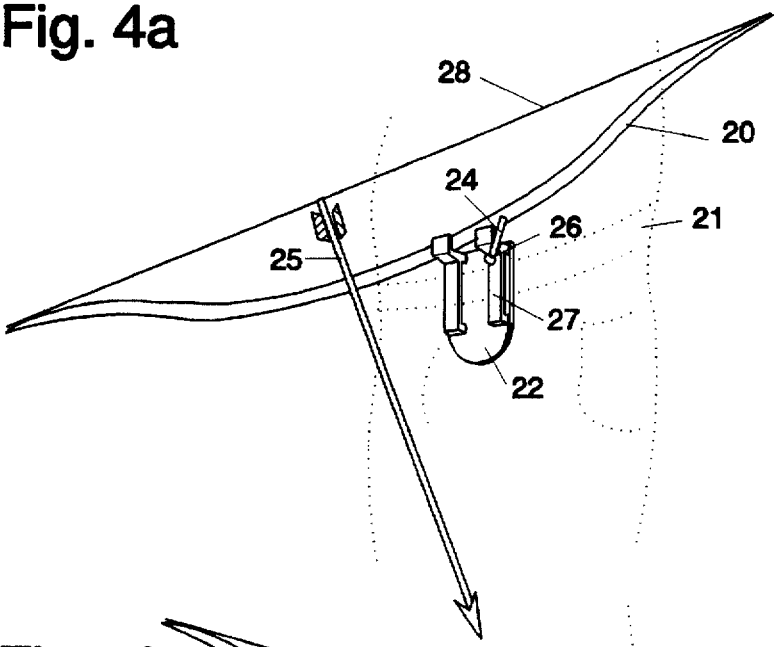
FIG. 4*a* shows a bow in place in the second embodiment of the invention, with the bow in its forward "ready" position.
Figure 4B:
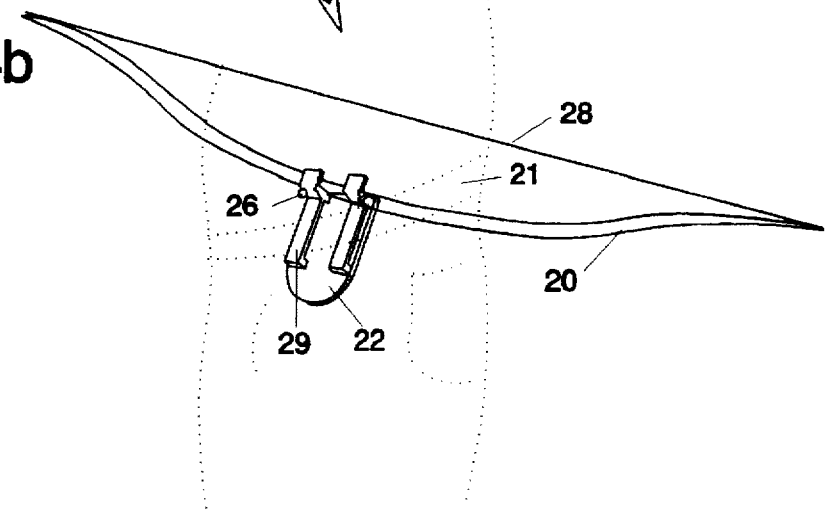
FIG. 4*b* shows a bow in place in the second embodiment of the invention, with the bow in its rearward "transport" position.
Figure 4C:
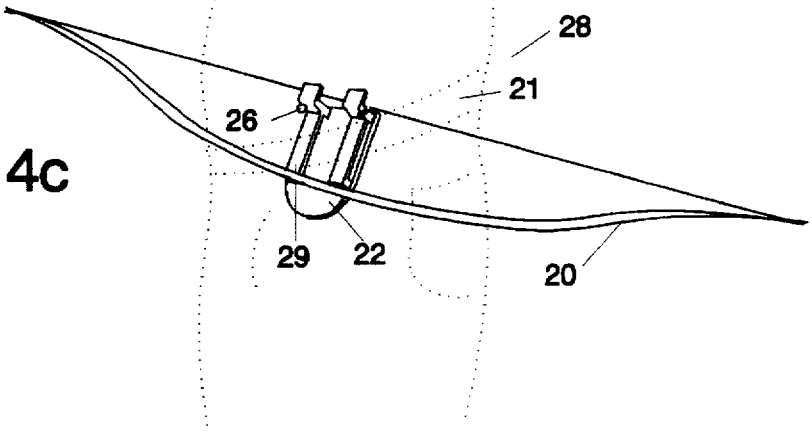
FIG. 4*c* shows a bow in place in the second embodiment of the invention, with the bow suspended by the bowstring.

FIGS. 4*a* and 4*b* show the preferred embodiment of the invention (as shown in FIG. 2) in use on a hunter's belt (21), with a bow (20) in place. In FIG. 4*a*, the bow (20) is in the "ready" position, with its center of gravity forward of the center of support, and an arrow (25) nocked and ready. The bolt and bushing (24) in the accessory hole on the handle of the bow (20) fits in the slot in the rearward body half (27), and the bolt head (26) rests against the bottom of the body half (27) extension to hold the bow from falling out. The slat built into the slot acts to force the bowstring (28) inward toward the hunter's upper body, and thus forces the point of the arrow (25) away from the hunter's leg.

In FIG. 4*b*, the bow (20) is in its rearward "transport" position, with its center of gravity to the rear. The bolt in the stabilizer bar hole is in the slot in the forward body half (29), with the bolt head (26) holding the bow firmly in place against the top of the holder.

The bow rest of the invention is light and easy to carry, fits on any belt (or, in the FIG. 5 embodiment, in a hunter's waistband), and fits most bows. A bow can be easily holstered by being placed on top of the rest and sliding it forward or back (depending on its position) until the bolt fits in the slot. Alternatively, the bowstring can be dropped into the string notch. There is no need for the hunter to take his eyes off the game or the tree stand. The bow is held firmly and at the correct angle, whether in the ready or transport position.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A waist-mounted bow holder comprising:

a) a stabilizing plate having an inner surface adapted for contact with a bearer's waist, an outer surface, upper and lower ends and a length therebetween;

b) a body having first and second vertical sides projecting outward from the outer surface of the stabilizing plate, and a horizontal upper surface, between the first and second vertical sides, adjacent to the upper end and projecting from an inward edge of the upper surface outward from the outer surface of the stabilizing plate a sufficient distance to support a bow thereon;

c) outer lip means for preventing the bow from slipping off the upper surface of the body, projecting upward from an outward edge of the upper surface of the body;

d) at least a first slot having first and second vertically spaced ends and a length therebetween with the first end being located at the horizontal upper surface of the body, and the length extending downward along one of the vertical sides to the second end; and a belt slot passing from the first vertical side to the second vertical side adjacent to the outer surface of the stabilizing plate, of dimensions selected to allow a user's belt to pass through the slot along the outer surface of the stabilizing plate such that the stabilizing plate is held against the user with the inner surface contacting the waist of the user.

2. The bow holder of claim 1 further comprising a bolt adapted to extend forward from the handle of a bow, the bolt having a diameter adapted to fit in the first slot in the body of the bow holder.

3. The bow holder of claim 2 in which the bolt further comprises a bolt head, and the second end of the first slot in the body of the bow holder is formed with a recess to contain the bolt head.

4. The bow holder of claim 2, in which the bolt has a bushing surrounding the bolt, the bushing having a diameter adapted to fit in the first slot in the body of the bow holder, and also having a flange portion having a larger diameter, such that when the bushing is slid into the first slot in the body of the bow holder, the flange portion locks the bow against the holder.

5. The bow holder of claim 1, further comprising a stabilizer bar adap[illegible] threaded into an accessory hole on a bow, and a sta[illegible] between the stabilizer bar and the accessory hole, [illegible] comprising a cylindrical body having a thread[illegible] the upper surface thereof adapted to receiving the [illegible] bar, a cylindrical reduced stem on the lower surface of [illegible] cylindrical body having a diameter adapted to fit into the first slot in the body of the bow holder, and a threaded bolt on the lower surface of the cylindrical reduced stem, threaded to fit into the accessory hole on the bow, such that when the threaded bolt of the standoff is threaded into the accessory hole of the bow, and the stabilizer bar is threaded into the threaded hole of the standoff, the bow may be locked into place on the bow holder by sliding the cylindrical reduced stem of the standoff into the first slot of the bow holder body.

6. The bow holder of claim 1, further comprising a second slot corresponding to the first slot, located in the other vertical side from the first slot, such that the body of the bow holder has slots on both vertical sides.

7. The bow holder of claim 1 in which the body includes a central vertical axis wherein the body is divided substantially symmetrically about the axis.

8. The bow holder of claim 1 in which the first slot is formed at a slat, such that the first slot is closer to the stabilizing plate at the first end than at the second end.

9. The bow holder of claim 1, further comprising a fitting attached to the stabilizing plate at the lower end thereof, such that a spike inserted into the fitting at its upper end and into the ground at its lower end supports a bow on the bow holder above the ground.

10. The bow holder of claim 1, further comprising inner lip means for preventing the bow from slipping off the horizontal upper surface of the body, located on the inward edge of the upper surface of the body.

11. The bow holder of claim 1, further comprising secondary lip means on an inner side of the outer lip means, forming a string notch between the outer lip means and the secondary lip means.

* * * * *